US005538555A

United States Patent [19]

Wille et al.

[11] Patent Number: 5,538,555

[45] Date of Patent: Jul. 23, 1996

[54] INDIRECT COATING DEVICE WITH APPLICATOR FOR PROVIDING A UNIFORM COATING ON AN APPLICATOR ROLL

[75] Inventors: Uwe Wille, Heidenheim; Richard Bernert; Oswald Satzger, both of Giengen, all of Germany

[73] Assignee: Voith Sulzer Papiermaschinen GmbH, Heidenheim, Germany

[21] Appl. No.: 376,817

[22] Filed: Jan. 23, 1995

[30] Foreign Application Priority Data

Jan. 26, 1994 [DE] Germany ..... 44 02 108.9

[51] Int. Cl.[6] ..... B05C 17/00

[52] U.S. Cl. ..... 118/261; 118/410; 118/413; 118/419; 15/256.51; 15/256.52

[58] Field of Search ..... 118/118, 119, 118/123, 126, 203, 249, 261, 410, 413, 419; 101/157, 169, 365; 15/256.51, 256.52; 162/281

[56] References Cited

U.S. PATENT DOCUMENTS

| | | | |
|---|---|---|---|
| 4,688,516 | 8/1987 | Sommer | 118/413 |
| 5,199,991 | 4/1993 | Chance | 118/410 |
| 5,328,511 | 7/1994 | Beisswanger | 15/256.51 |

FOREIGN PATENT DOCUMENTS

| | | |
|---|---|---|
| 2081143 | 4/1993 | Canada . |
| 3734900 | 12/1988 | Germany . |
| 4135195 | 4/1993 | Germany . |

*Primary Examiner*—Laura Edwards
*Attorney, Agent, or Firm*—Marshall, O'Toole, Gerstein, Murray & Borun

[57] ABSTRACT

A device for coating a material web includes a rotatable applicator roll having a surface for collecting a film of a coating composition thereon. The roll has a length defined by first and second ends thereof and a middle region disposed between the first and second ends. The device also includes a blade having an edge. The blade is attached to a blade holder and extends along the length of the applicator roll. The blade and the applicator roll surface form an acute angle and define a coating composition sump. The blade edge and the applicator roll surface define an inlet gap. A doctor element attached to a doctor element holder is disposed downstream of the blade with respect to a direction of rotation of the applicator roll. The blade, the blade holder, the doctor element, and the doctor element holder define, at least in part, an application chamber. At least one of the elements defining the application chamber has bores or other openings for regulating coating composition thickness on the applicator roll.

10 Claims, 4 Drawing Sheets

INDIRECT COATING DEVICE WITH APPLICATOR FOR PROVIDING A UNIFORM COATING ON AN APPLICATOR ROLL

FIELD OF THE INVENTION

The invention relates to devices for coating running webs of material, particularly paper webs.

DESCRIPTION OF RELATED TECHNOLOGY

Devices for coating material webs are known which include a cylindrical rotating applicator roll, the surface of which serves to take up a coating composition film and an application device for applying the coating composition film onto the surface of the roll. Such an application device includes a blade which is as wide as the coating machine (i.e., as wide as the length of the cylindrical applicator roll), and forms an acute angle with the surface of the applicator roll. The blade and the surface of the applicator roll define a coating composition sump. A free edge of the blade and the surface of the applicator roll also define an inlet gap. A doctor element is disposed downstream of the blade with respect to the direction of rotation of the applicator roll. The doctor element adjusts the thickness of the coating film on the surface of the applicator roll. An application zone is defined by the inlet gap and the doctor element. The blade, a corresponding blade holder, the doctor element, a corresponding doctor holder, and optionally other walls, partially define an application chamber. The chamber is further defined by retaining shields disposed in the vicinity of the ends of the applicator roll (i.e., at the edges of a web of material being conveyed over the applicator roll).

In coating devices of this type, a web of material is usually coated with the coating composition in an indirect manner. First, the surface of the applicator roll is coated with a coating composition film and then the coating composition film is transported to a deposition point as the applicator roll rotates. At the deposition point, the web to be coated takes up the coating composition film. However, it is also possible to apply the film directly onto the web. In such a method and apparatus, the web to be coated loops about the surface of an applicator roll and travels through the application zone where the coating composition is applied to the web.

To ensure coating of good quality, numerous requirements must be met. The most important requirement is the uniformity of application of the coating composition. The coating should be uniform with respect to the length of the web (i.e., with respect to the direction of travel of the web) as well as to the web width (i.e., with respect to a direction transverse to the direction of travel of the web). Uniform coating requires a coating film of constant thickness as well as constant area weight (which generally are the same). The film should show no irregularities, especially no streaking.

Severe coating problems may arise in such coating devices wherein the application chamber (formed by the blade, the blade holder, the doctor element, the doctor holder and the surface of the applicator roll) receives its inlet flow through a gap which is as wide as the coating machine and is between the blade free edge and the surface of the applicator roll. The coating composition leaves the application chamber between the surface of the roll and the metering doctor in the form of the film. The application chamber is closed at its sides, i.e., in the region of the web edges, by retaining shields. Because the retaining shields are fixed as compared to the applicator roll which rotates, the closure of the application chamber is incomplete and therefore there is a certain leakage of the coating composition on the sides of the chamber defined by the retaining shields. Thus, the coating composition flows from the application chamber toward the outside of the chamber. As a result, in the application chamber in the region of the web edges, the height of the coating composition is somewhat lower than in the remainder of the chamber. This height reduction leads to a reduction of the amount of coating composition available in the region of the web edges and thus to a reduced thickness of the coating composition film in the region of the web edges.

SUMMARY OF THE INVENTION

It is an object of the invention to overcome one or more of the problems described above. It is also an object of the invention to provide a device according to the invention wherein coating composition film leaves an application chamber in a uniform thickness and, particularly, the coating film is not thinner in the region of the ends of the roll than in the middle region of the roll.

According to the invention, a device for coating a material web includes a rotatable applicator roll having a surface for collecting a film of a coating composition thereon. The roll has a length defined by first and second ends thereof and a middle region disposed between the first and second ends. The device also includes a blade having an edge. The blade is attached to a blade holder and extends along the length of the applicator roll. The blade and the applicator roll surface form an acute angle and define a coating composition sump. The blade edge and the applicator roll surface define an inlet gap. A doctor element attached to a doctor element holder is disposed downstream of the blade with respect to a direction of rotation of the applicator roll. Retaining surfaces of the blade, the blade holder, the doctor element, and the doctor element holder define, at least in part, an application chamber. The device includes at least one of (a) apparatus for regulating flow of the coating composition at the inlet gap of the application chamber to result in the deposition of more coating composition on the applicator roll at the inlet gap in the vicinity of the applicator roll ends than in the vicinity of the middle region of the applicator roll or (b) a flow regulation system wherein at least one of the elements defining the application chamber has outlet openings disposed in the vicinity of the middle region of the applicator roll surface.

Other objects and advantages of the invention will be apparent to those skilled in the art from the following detailed description taken in conjunction with the drawings and the appended claims.

DETAILED DESCRIPTION OF THE INVENTION

The figures show coating devices according to the invention wherein means are provided to regulate coating composition flow in order to correct or compensate for the flow in the edge or end regions of a coating application device.

Figure 1:
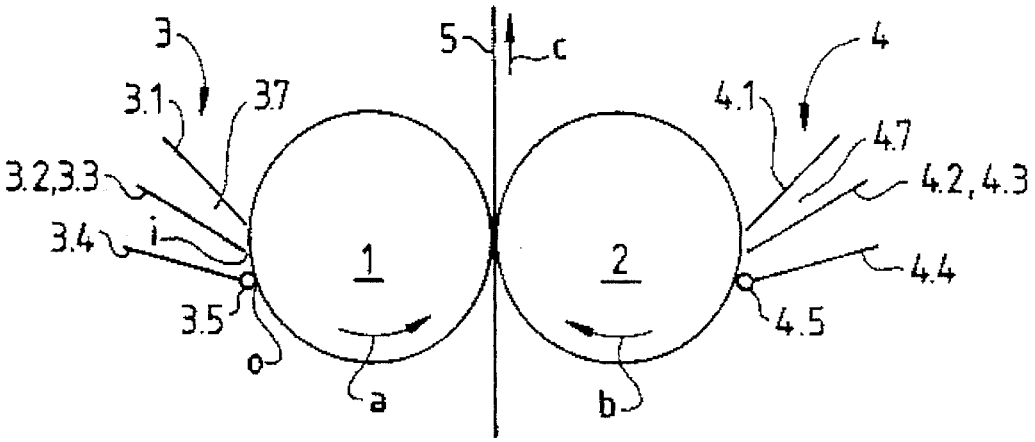
FIG. 1 is a schematic sectional view of a device according to the invention.

FIG. 1 illustrates a device according to the invention for the indirect coating of a paper web. Two applicator rolls 1 and 2 cooperate with two applicator devices 3 and 4, respectively. Each applicator device includes the following elements: a back wall 3.1, 4.1; a blade holder 3.2, 4.2 with attached blade 3.3, 4.3; and a doctor holder 3.4, 4.4 with attached doctor element 3.5, 4.5. The two rolls 1 and 2 run or rotate in opposite directions as indicated by arrows a and b. The rolls 1 and together define a roll gap g through which a paper web 5 is conveyed in a direction indicated by an arrow c.

Surfaces of the two rolls 1 and 2 rotate or run past sumps 3.7 and 4.7, respectively and then past a free edge of blades 3.3 and 4.3, respectively. A gap i is defined by each blade (3.3 and 4.3) free edge and the surface of the roll (1 and 2) disposed adjacent to the blade edge. (The word adjacent is defined herein as near or close, but not necessarily touching.) The gap i formed by each blade edge and respective roll is as wide as the machine, i.e., the gap extends along the length of each roll 1 and 2 from end to end. The surface of the rolls 1 and 2 then travel past a free edge of the blades 3.3 and 4.3, respectively, and then further to the doctor elements 3.5 and 4.5, respectively. Thus, the surfaces travel past an application chamber defined by the blades 3.3. and 4.3 and the doctor elements 3.5 and 4.5, respectively, wherein a coating composition film of a defined thickness is deposited thereon. The coating composition film is then applied at the roll gap g onto the sides of the paper web 5.

Figure 2:
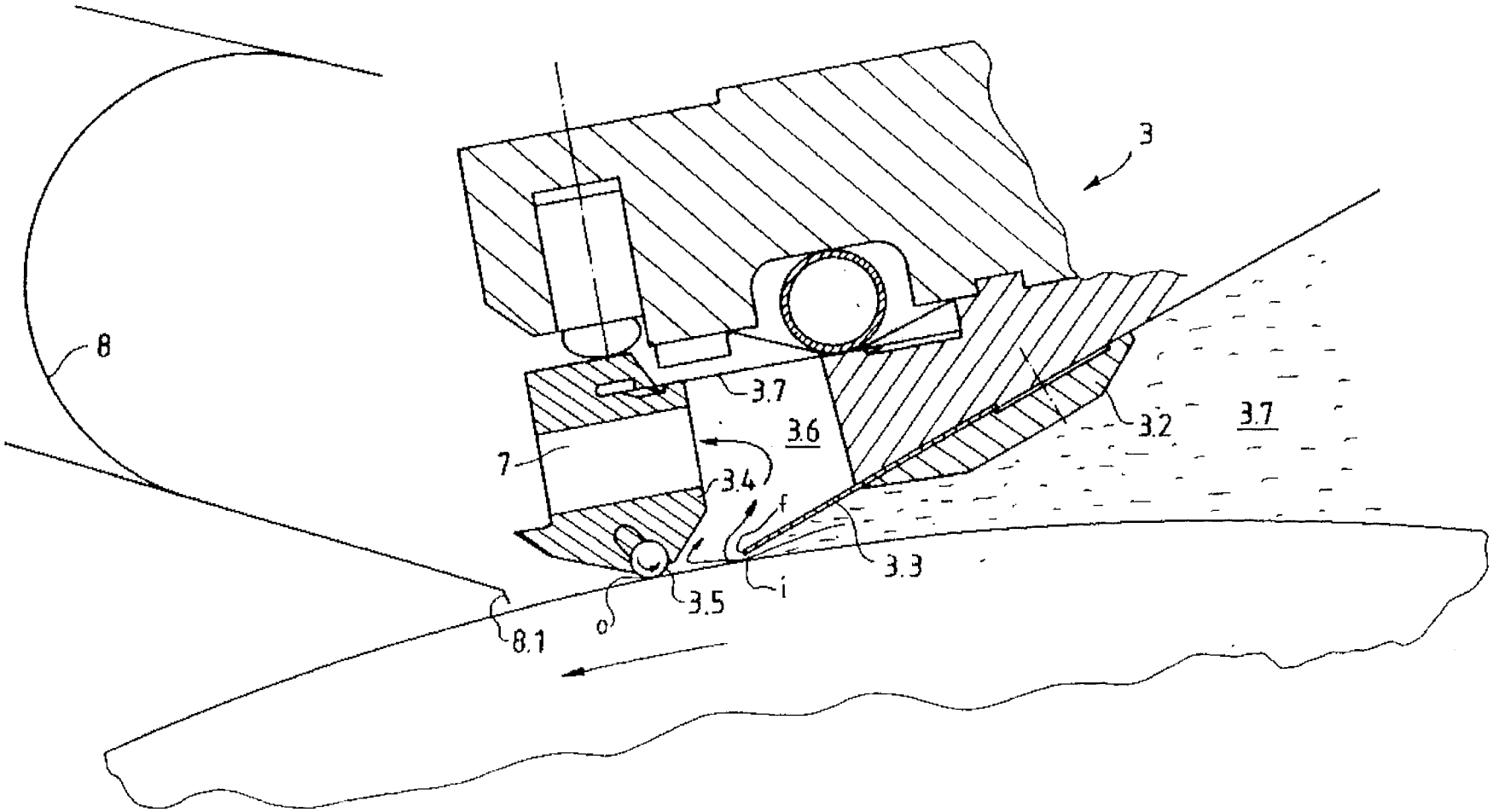
FIG. 2 is an enlarged and partial cross-sectional view of the device of FIG. 1.

FIG. 2 illustrates a portion of one of the coating application devices 3 according to the invention shown in FIG. 1. In FIG. 2, the application device 3 is shown on a larger scale than what is shown in FIG. 1 to provide a more detailed depiction of the device. The back wall 3.1 is omitted in the embodiment shown in FIG. 2. The application device 3 is disposed at a descending part of the applicator roll 1 so that a substantially horizontal liquid level of the sump 3.7 can develop. FIG. 2 shows the blade holder 3.2 as well as the blade 3.3 connected thereto and supported thereby. A free end f of the blade 3.3 forms the gap i with the surface of the applicator roll 1. The coating composition passes through the gap i from the sump 3.7. An application or retaining chamber 3.6 is defined by the blade 3.3, a portion of the blade holder 3.2, the doctor holder 3.4, the doctor element 3.5 (which is in the form of a doctor roll), a portion of the surface of the applicator roll 1, and a covering plate 3.7.

In the device according to the invention shown in FIG. 2, the doctor holder 3.4 has a plurality of openings in the form of bores 7. According to the invention, a partial amount of the coating composition can leave the application chamber 3.6, preferably through the plurality of bores 7. The bores 7 open into a chamber or collecting channel, which is surrounded by a collecting channel wall 8. The collecting channel wall 8 has a free or open edge 8.1, which is adjustable in placement. The function of the free edge 8.1 is to protect against spray of the coating composition.

The bores 7 in the doctor holder 3.4 provide for the removal of a partial amount of the coating composition from the application chamber 3.6. The bores 7 are shaped and disposed in such a way that, in a middle region along the length of the applicator roll, a relatively large amount of coating composition leaves the application chamber, but relatively little or no coating composition leaves at the edges or ends of the chamber corresponding to edges of a material web being coated.

Figure 3:
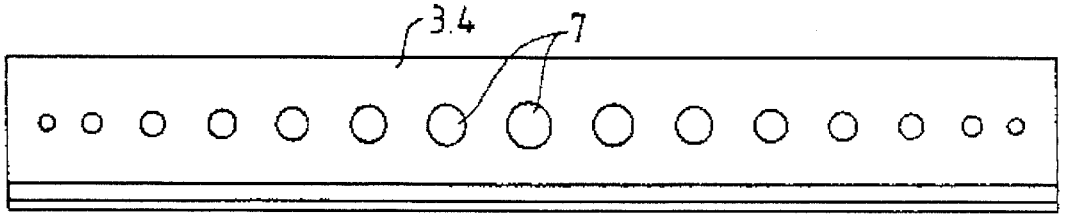
FIG. 3 is an enlarged and partial front view of a doctor holder of the device of FIGS. 1 and 2.
Figure 4:
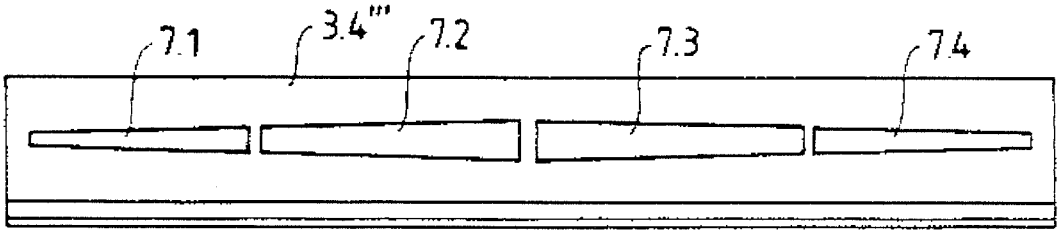
FIG. 4 is an enlarged and partial front view of an alternative embodiment of a doctor holder of the device of FIGS. 1 and 2.

Two different embodiments of application chambers according to the invention are shown in FIGS. 3 and 4. Both FIGS. 3 and 4 show front views of doctor holders 3.4 and 3.4'", respectively, according to the invention (the front of the holder being defined herein as a face of the holder disposed opposite the portion of the holder through which the coating composition exits. FIG. 3 shows a holder having circular bores 7. The diameters of the bores 7 decrease from the middle portion of the holder toward the edges thereof.

In the embodiment according to the invention shown in FIG. 4, the doctor holder 3.4'" has slitted sections 7.1, 7.2, 7.3 and 7.4. As with the bores 7 illustrated in FIG. 3, the width of the slits in the holder 3.4'" decreases from the middle (slits 7.2. and 7.3) toward the edges (slits 7.1 and 7.4) of the holder 3.4'".

It is also possible to partially or totally cover the openings 7, regardless of whether they are bores or slits by a shutter (not shown). Also, a sliding plate (not shown) can be utilized to adjustably cover either all or a portion of each individual opening. However, a common sliding plate (not shown) may also be provided that has openings corresponding to the openings in the doctor holder. In such an embodiment, the sliding plate can be shifted in such a way that the bores in the doctor holder and the bores in the sliding plates overlap completely or partially.

However, the bores 7, or other openings, can also be provided in any other boundary wall of the application chamber 3.6. Thus, it is conceivable to provide openings in the cover plates 3.7 or in the blade holder 3.2.

It is also possible to provide openings in two or more of the boundary walls (i.e., side retaining shields) of the application chamber 3.6.

However, the purpose of the bores 7 or slits 7.1–7.4 is not only to compensate for out- or over-flow of the coating composition at the edges or ends of the application chamber. Such openings can also provide satisfactory and orderly flow from the sump 3.7 through the gap i, into the application chamber 3.6 and, furthermore, flow from the application chamber 3.6 to the sump 3.7. Thus, "dead corners" and the corresponding danger of undesirable coating composition deposits are avoided.

Also according to the invention, additional flow control from the application chamber can be provided by the inlet gap i being of unequal size along its length, that is, along the length of applicator roll 1 (corresponding to the width of a web being coated). In particular, the width of the gap i increases toward the edges or ends of the applicator roll. As a result, the gap i compensates for the undesired flow of coating composition from the ends of the application chamber.

Figure 5:
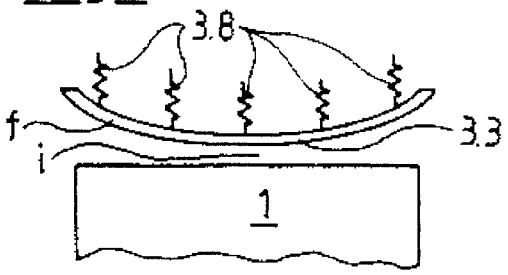
FIG. 5 is an enlarged and partial view of the device of FIG. 2.

FIG. 5 shows the gap i of FIGS. 1 and 2 defined by the edge f of the blade 3.3 and the applicator roll 1o FIG. 5 illustrates a view of the gap that is against the flow of the coating composition flowing through the gap i. As can be seen, the free edge f of the blade 3.3 is parabolic in shape so that the gap i width increases toward the ends of the applicator roll 1. The blade 3.3 may also be formed into other shapes by a corresponding displacement mechanism, such as threaded spindles 3.8. The displacement mechanism can, for example, also operate pneumatically or hydraulically. The spindles 3.8 or other displacement mechanism allow the size or width of the inlet gap to be adjustable, providing means for varying or adjusting the amount of coating composition entering in particular regions of the application chamber.

Also according to the invention, the width of an outlet gap o defined by the doctor element 3.5 and the surface of the applicator roll 1 can be of varying sizes across the length thereof. According to the invention, the width of the outlet gap o should increase toward the ends of the applicator roll 1.

Numerous types of doctor elements may be utilized in the device according to the invention. The use of a doctor roll has already been mentioned herein. However, scrapers or other types of fixed doctor elements may also be used. If doctor rolls are utilized, they may be ridged doctors, profiled rods or wire-wound rods.

Figure 6:
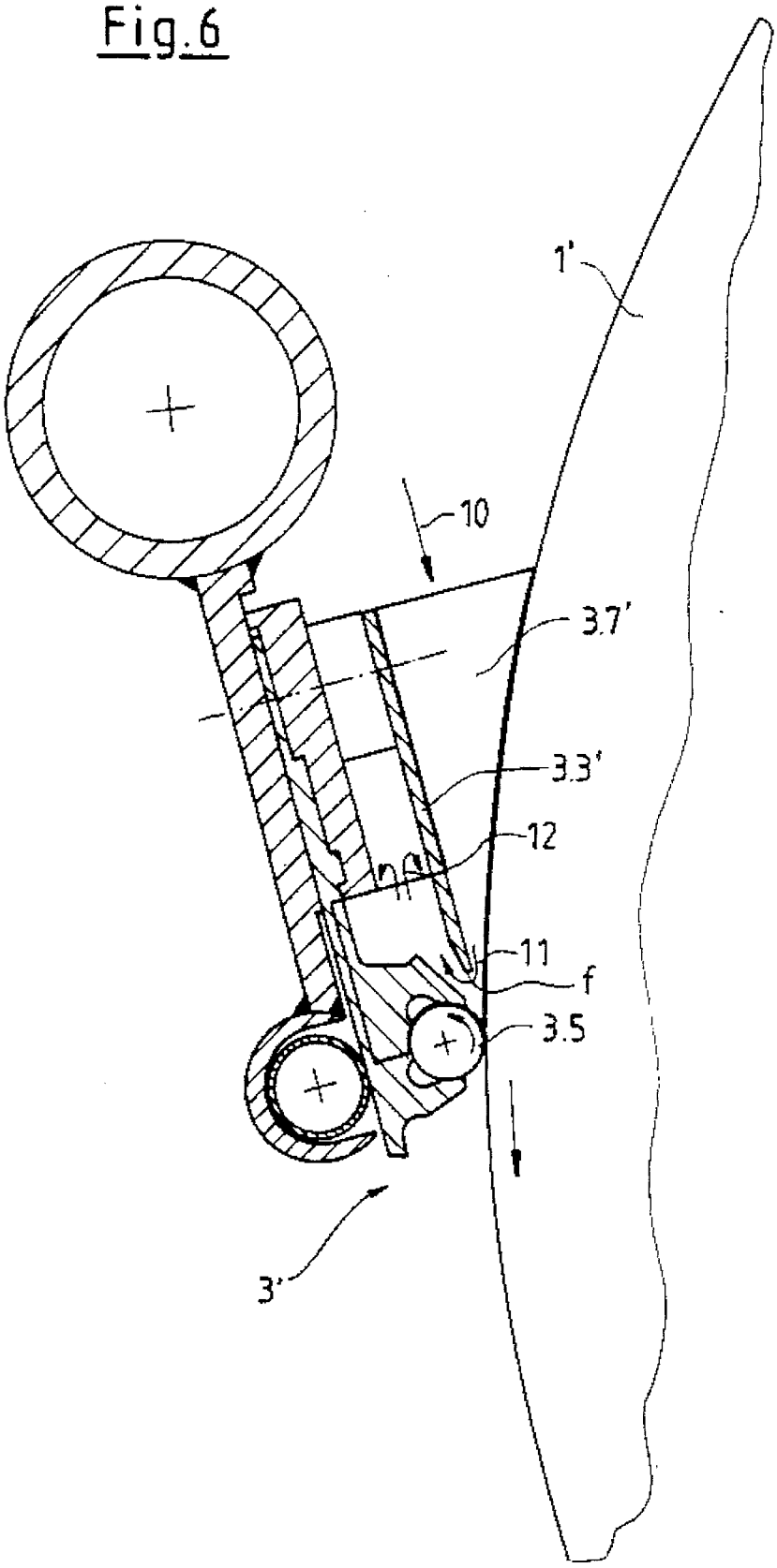
FIG. 6 is a cross-sectional view of a second embodiment of a device according to the invention.

Similar to the device 3 shown in FIG. 2, an application device 3' according to the invention is shown in FIG. 6. Here too a sump 3.7' is formed between the surface of an applicator roll 1' and a blade 3.3'. An inlet of the device 3' is disposed at a top thereof and is indicated by an arrow 10 which also shows the direction of flow of the coating composition into the device 3'. The coating composition flows around a free edge f' of the blade 3.3' and indicated by an arrow 11. A desired partial amount of the coating composition leaves the application device on both sides of the device as indicated by arrows 12. Thus, only new or fresh coating composition flows into a sump 3.7'. Therefore, entry of foreign particles cannot occur.

Figure 7:
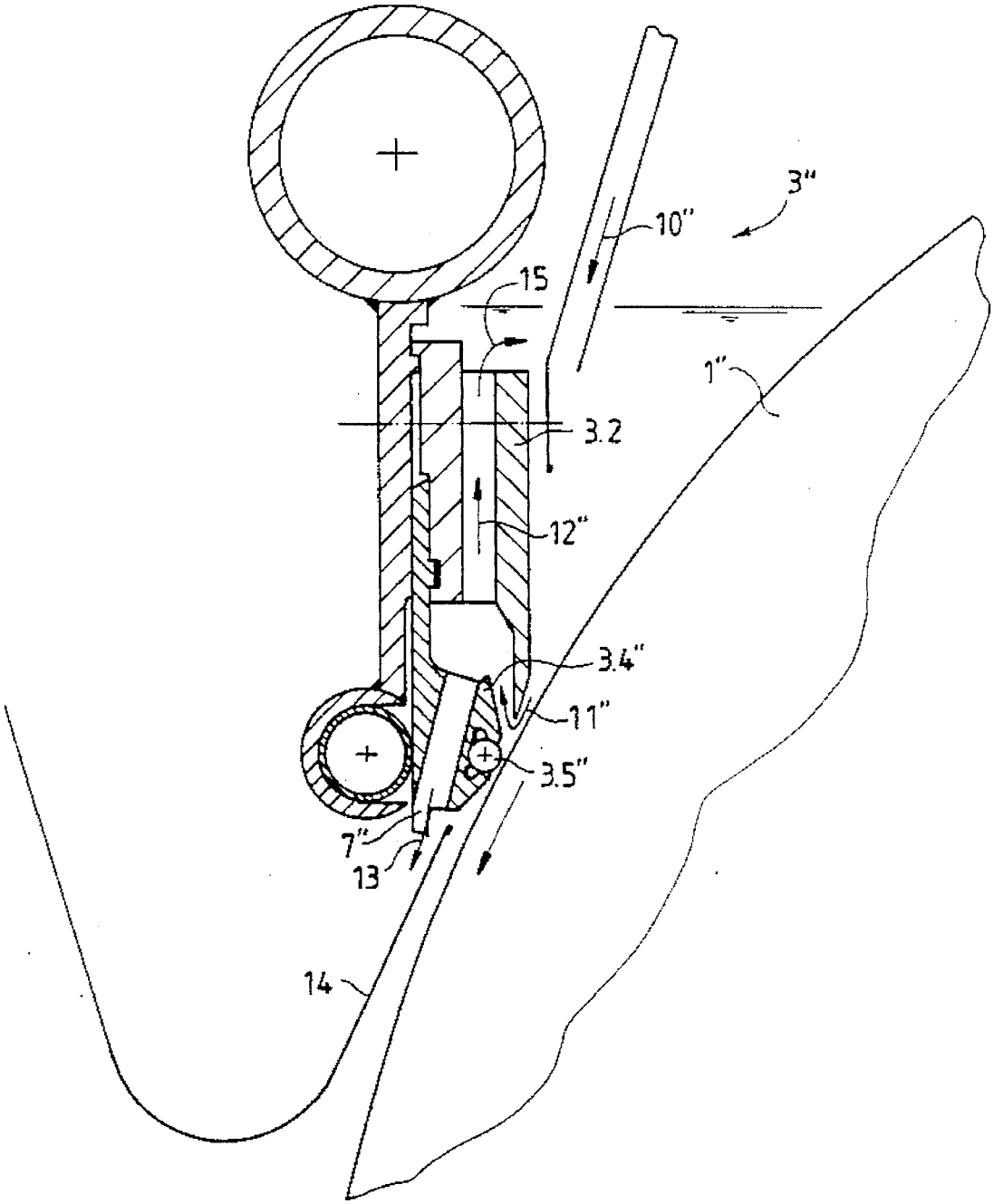
FIG. 7 is a cross-sectional view of a third embodiment of a device according to the invention.

An embodiment of a device according to the invention shown in FIG. 7 is similar to the embodiments shown in FIGS. 6 and 2 and includes a particular flow system of coating composition through the device. In a device 3" shown in FIG. 7, a doctor holder 3.4" of the device has a plurality of holes 7" (similar to the device shown in FIG. 2) through which a partial amount of coating composition flows in a direction indicated by an arrow 13 and is captured in a collecting trough 14. Another partial amount of the coating composition flows in a direction indicated by an arrow 12 through slits in a blade holder 3.2", about the device as indicated by an arrow 15, and then re-enters the sump with the new composition feed 10".

In the embodiment of the invention shown in FIG. 7, a partial amount of the coating composition is discharged from the flow system of the device 3" in the direction shown by the arrow 13 while the other portion of the coating composition remains in the system, flowing along in the direction of the arrow 15 and thus becoming a component of an inner flow cycle. The inner flow cycle ensures good flushing of the doctor element 3.5", in order to avoid the adherence of particles onto the doctor element 3.5".

The foregoing detailed description is given for clearness of understanding only, and no unnecessary limitations should be understood therefrom, as modifications within the scope of the invention will be apparent to those skilled in the art.

We claim:

1. A device for coating a material web comprising:

a rotatable applicator roll having a surface for collecting a film of a coating composition thereon, said roll also having a length defined by first and second ends thereof and a middle region disposed between the first and second ends;

a blade having an edge, said blade attached to a blade holder and extending along the length of the applicator roll, said blade and said applicator roll surface forming an acute angle and defining a coating composition sump, said blade edge and said applicator roll surface defining an inlet gap; and a doctor element attached to a doctor element holder, said doctor element disposed downstream of said blade with respect to a direction of rotation of said applicator roll, said doctor element for adjusting the thickness of the coating composition film on said surface of said applicator roll;

wherein said blade, said blade holder, said doctor element, and said doctor element holder define at least in part an application chamber having outlet openings, said openings disposed in the vicinity of the middle region of the applicator roll surface.

2. The device of claim 1 wherein each of said openings decrease in size in a direction toward the ends of the applicator roll.

3. The device of claim 1 wherein the size of said openings is adjustable.

4. The device of claim 1 wherein said openings are bores.

5. The device of claim 1 wherein said openings are slits.

6. The device of claim 1 wherein the inlet gap is larger in the vicinity of the ends of the applicator roll than in the vicinity of the applicator roll middle region.

7. The device of claim 6 wherein the size of the inlet gap is adjustable.

8. The device of claim 1 wherein the size of an outlet gap defined by the doctor element and the surface of the applicator roll is larger in the vicinity of the ends of the applicator roll than in the vicinity of the applicator roll middle region.

9. A device for coating a material web comprising:

a rotatable applicator roll having a surface for collecting a film of a coating composition thereon, said roll also having a length defined by first and second ends thereof and a middle region disposed between the first and second ends;

a blade having an edge, said blade attached to a blade holder and extending along the length of the applicator roll, said blade and said applicator roll surface forming an acute angle and defining a coating composition sump, said blade edge and said applicator roll surface defining an inlet gap;

a doctor element attached to a doctor element holder, said doctor element disposed downstream of said blade with respect to a direction of rotation of said applicator roll, said doctor element for adjusting the thickness of the coating composition film on said surface of said applicator roll;

an application chamber defined at least in part by said blade, said blade holder, said doctor element, and said doctor element holder; and at least one of (a) means for regulating flow of the coating composition at said inlet gap to result in the deposition of more coating composition on the applicator roll at said inlet gap in the vicinity of the applicator roll ends than in the vicinity of the middle region of the applicator roll; and (b) means for regulating flow of the coating composition through the application chamber wherein at least one of said blade, said blade holder, said doctor element, and said doctor element holder chamber defining elements has openings disposed in the vicinity of the middle region of the applicator roll surface.

10. The device of claim 9 wherein said flow regulation means of sub-paragraph (a) is provided by the inlet gap being larger in size in the vicinity of the ends of the applicator roll than in the vicinity of the applicator roll middle region.

* * * * *